United States Patent [19]

Boadway

[11] Patent Number: 4,842,145

[45] Date of Patent: Jun. 27, 1989

[54] ARRANGEMENT OF MULTIPLE FLUID CYCLONES

[75] Inventor: John D. Boadway, Kingston, Canada

[73] Assignee: B.W.N. Vortoil Rights Co. Pty. Ltd., Danenong, Australia

[21] Appl. No.: 89,262

[22] Filed: Aug. 25, 1987

Related U.S. Application Data

[60] Continuation-in-part of Ser. No. 854,716, Apr. 16, 1986, abandoned, which is a continuation-in-part of Ser. No. 661,455, Oct. 16, 1984, abandoned, which is a continuation of Ser. No. 473,479, Mar. 9, 1983, abandoned, which is a division of Ser. No. 275,987, Jun. 22, 1981, Pat. No. 4,389,307.

[51] Int. Cl.[4] ..... B04C 5/13; B04C 5/181

[52] U.S. Cl. ..... 209/144; 209/211; 210/512.1; 55/459.1; 55/459.2

[58] Field of Search ..... 209/144, 211; 210/512.1, 512.2; 55/459 R, 459 A, 459 B, 459 C, 459 D

[56] References Cited

U.S. PATENT DOCUMENTS

| | | | |
|---|---|---|---|
| 2,816,490 | 12/1957 | Boadway et al. | 209/211 |
| 2,849,117 | 8/1958 | Rietema | 209/211 |
| 2,927,693 | 3/1960 | Freeman | 209/211 |
| 3,366,247 | 1/1968 | Viseman | 209/211 |
| 3,613,887 | 10/1971 | Wikdahl | 209/211 |
| 3,696,934 | 10/1972 | Oisi | 209/211 |
| 3,743,095 | 7/1973 | Mensing | 210/512.1 |
| 3,764,086 | 10/1973 | Wikdahl | 209/211 |
| 3,802,570 | 4/1974 | Dehne | 210/512.1 |
| 4,005,998 | 2/1977 | Goreman | 55/459 R |
| 4,094,794 | 6/1978 | Rahmann | 209/211 |
| 4,216,095 | 8/1980 | Ruff | 209/211 |
| 4,267,048 | 5/1981 | Ohishi | 209/211 |
| 4,389,307 | 6/1983 | Boadway | 209/211 |
| 4,414,112 | 11/1983 | Simpson | 210/512.1 |
| 4,572,783 | 2/1986 | Watson | 210/512.1 |
| 4,585,466 | 4/1986 | Syred | 55/459 R |
| 4,612,120 | 9/1986 | Box | 210/512.1 |

FOREIGN PATENT DOCUMENTS

| | | | |
|---|---|---|---|
| 1134443 | 4/1957 | France | 209/144 |
| 44697 | 7/1961 | Poland | 209/211 |
| 238137 | 10/1945 | Switzerland | 209/211 |

*Primary Examiner*—Kenneth M. Schor
*Assistant Examiner*—Thomas M. Lithgow
*Attorney, Agent, or Firm*—Richard J. Hicks

[57] ABSTRACT

A special form of fluid cyclone in which the velocity energy in the exit fluid is converted into exit pressure, thus permitting the device to discharge to atmospheric pressure or a higher pressure while a vacuum may exist in the central core of the vortex. A vortex finder defines an uninterrupted annular outlet passage that gradually increases in cross sectional flow area from an axial inlet to a tangential outlet. The length of the axial inlet portion is sufficiently long relative to the radial portion to insure a gradual transition of velocity energy into pressure, thereby avoiding vortex instability in the outlet passage.

13 Claims, 8 Drawing Sheets

ARRANGEMENT OF MULTIPLE FLUID CYCLONES

This application is a continuation in part of application Ser. No. 854,716 filed Apr. 16, 1986, abandoned, which in turn is a CIP of Ser. No. 661,455, filed Oct. 16, 1984, abandoned, which is a continuation of Ser. No. 473,479, filed Mar. 9,1983, abandoned, which is a division of Ser. No. 275,987, filed June 22, 1981, and now U.S. Pat. No. 4,389,307.

This invention relates to a special form of fluid cyclone in which the velocity energy in the exit fluid is converted into exit pressure thus permitting the device to discharge to atmospheric pressure or a higher pressure while a vacuum may exist in the central core of the vortex.

The principles of the invention may be applicable, where the fluid is a liquid or a gas and permits removal of solid or liquid particles of higher density than the main fluid.

Fluid cyclones and hydrocyclones have been in use for some time by the paper industry and metallurgical industry. These devices are described in the testbook "Hydrocyclones" written by D. Bradley and published by the Pergamon Press.

The most common form of hydrocyclone is the straight conical design. Fluid enters by a tangential inlet into a short cylindrical portion. A vortex is created below the cylindrical portion and a conical portion below the cylindrical portion as fluid spirals in a path moving downward and inward, then upward in a helical path to an exit pipe co-axial with the cylindrical portion. The centrifugal acceleration, due to rapid rotation of the fluid, causes dense particles to be forced outward to the wall of the cylinder and cone.

The dense particles are transported in the slower moving boundary layer downward towards the apex of the cone where they leave as a hollow cone spray. The high centrifugal force near the centre opens up a liquid free space which is referred to as a vortex core. In the conical cyclone, with free discharge of rejects of the atmosphere, this core is filled with air and a back pressure at the exit of the hydrocyclone is required to prevent air insuction.

In some designs the cylindrical portion is much longer than in others. One design having a longer cylindrical portion is sold under the trade name "Vorvac" which was designed to remove both dirt and gas simultaneously. The general flow pattern is similar to that described for conical designs, but there is an additional downward moving helical flow next to the core carrying froth or light material. This extra flow is obtained because of the use of a device at the exit which will be discussed later and referred to as a core trap. The reject flow from the Vorvac is usually to a vacuum tank and the entire fluid in the device is below atmospheric pressure in order to expand gas bubbles so they can be taken out more readily.

Another known device sold under the trade name "Vorject" has a conventional type of fluid flow pattern, but the conical reduction at the bottom is used to turn back the main downward flow towards the main fluid exit, but not to limit discharge of reject flow. The boundary layer fluid containing the reject material is separated from the rest of the fluid nearer the centre by use of a core trap and it issues forth from a tangential exit under pressure. The rejection of material and prevention of air insuction in this type of design is not affected by outlet pressure. Rejection of material may be controlled by throttling of the reject stream and may also be limited by injection of water to carry back fine material while removing coarser material.

Various designs of fluid cyclones and other vortex separators are disclosed in the following U.S. Pat. Nos: 2,982,409; 2,835,387; 3,421,622; 2,849,930; 3,785,489; 3,543,932; 2,816,490; 3,734,288; 3,861,532; 2,757,581; 3,716,137; 3,057,476; 2,920,761; 3,696,927; 3,353,673; 2,757,582; 3,612,276; 3,288,286; 2,927,693; 3,101,313.

The fluid leaving a fluid cyclone has a very high tangential velocity about the central axis and quite a high axial velocity. In most designs this velocity energy becomes dissipated as turbulence in the exit piping.

A principal object of the present invention is to provide a modified design for the recovery of energy in the fluid which in previous designs was lost.

In keeping with the foregoing there is provided in accordance with one aspect of the present invention in a fluid cyclone having an upper cylindrical end portion with an inlet thereto and outlet therefrom, each of which is tangential to said cylindrical portion, said cylindrical portion merging into a lower conical portion which tapers inwardly towards a cone plate means positioned directly beneath a reject outlet in the lower end of said lower portion and the cone plate means, the improvement comprising vortex finder means defining an uninterrupted annular outlet passage, having an axial portion and a radial portion, that gradually increases in cross sectional flow area from an axial inlet in the cylindrical portion of the cyclone upwardly toward said tangential outlet, and said passage merging smoothly into said tangential outlet, said means defining said outlet passage comprising an inner core cone and an outer core cone spaced from one another, the inlet to said annular passage being disposed co-axially with said cylindrical portion of the cyclone, and the length of the axial portion of the outlet passage being sufficiently long relative to the radial portion thereof so as to induce a gradual transition of velocity energy into pressure energy and thereby avoiding vortex instability in said outlet passage.

The invention is illustrated by way of example in the accompanying drawings wherein.

Figure 1:
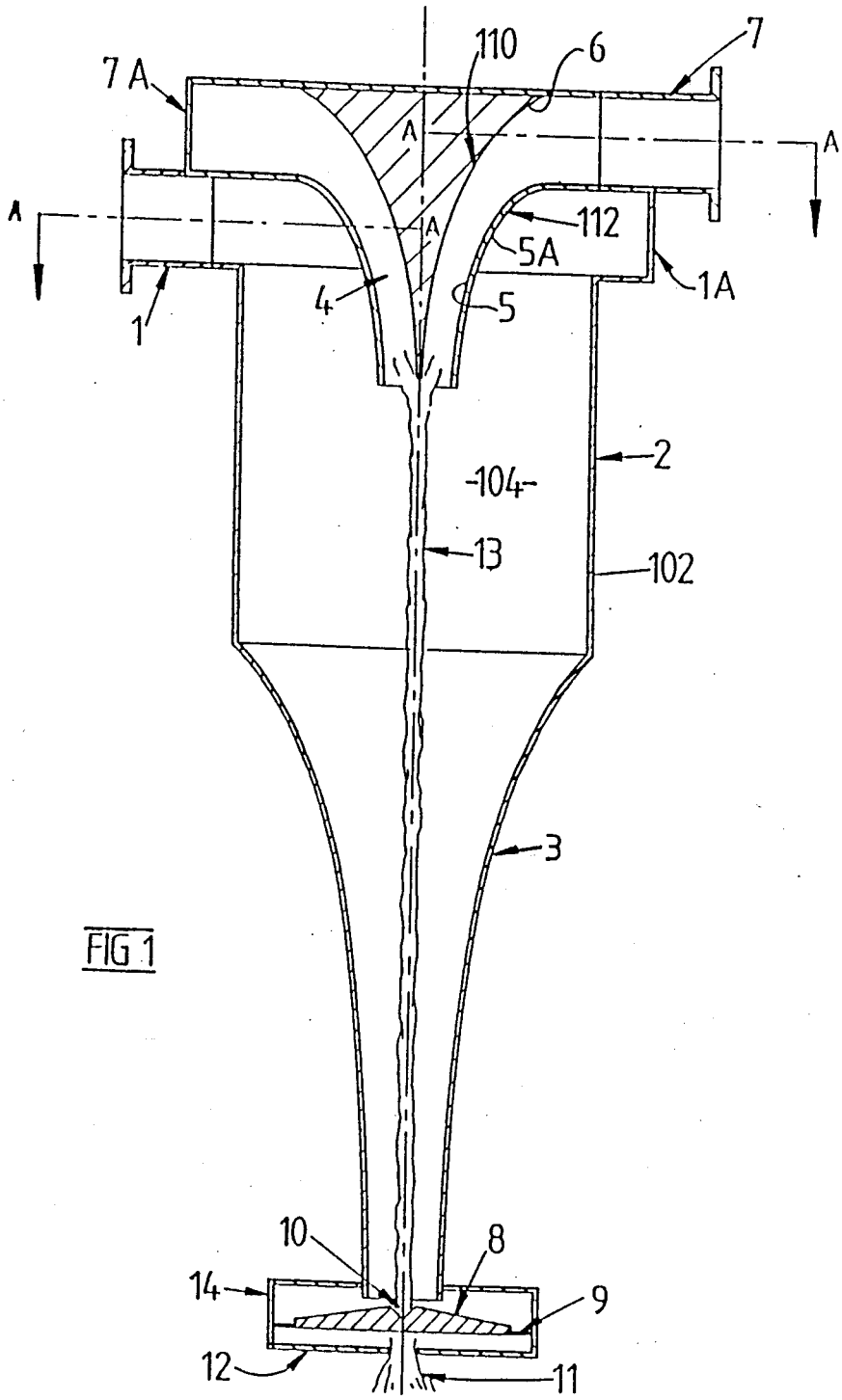
FIG. 1 is an exial cross-section of a fluid cyclone constructed in accordance with the invention.
Figure 2:
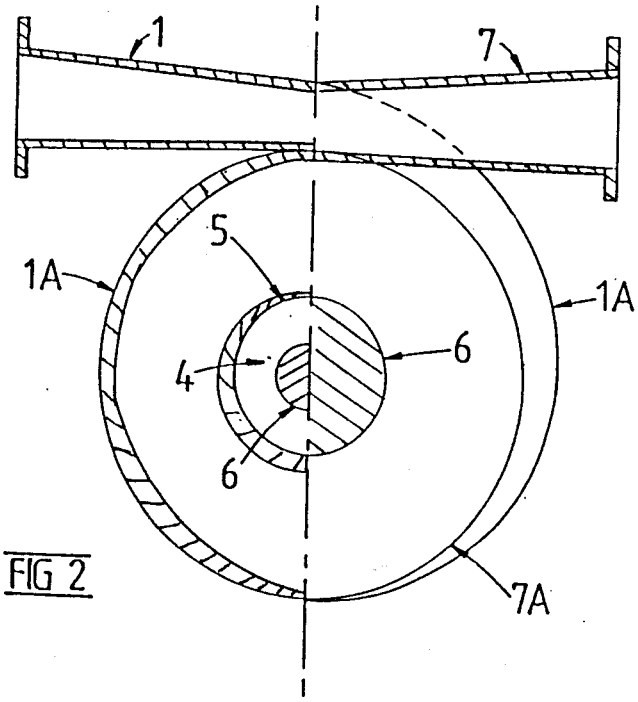
FIG. 2 is a view essentially on the line in FIG. 1.

The hydrocyclone shown in FIGS. 1 and 2 comprises an axially extending casing 102 which is hollow and of circular transverse cross-section. The casing 102 is of generally tapered form. As shown, the larger diameter end of the casing 102 is uppermost and the smaller diameter end lowermost. In the following description, and the appended claims, the cyclone will be described in this particular orientation. However, this is purely for convenience, it being understood that the separator will operate in any orientation and the terms "upper" and "lower" as used in this description and claims should not be construed as limiting the described cyclone to any particular orientation.

The casing 102 defines therewithin a separating chamber 104 which, likewise, is of upright tapered form. At the upper, larger diameter, end of the casing 102, the cyclone is provided with a tangential entry 1 opening to the separating chamber 104 via a spiral chamber 1A also positioned at the upper end of the cyclone. Also at the upper end of the casing 102 is a fluid exit passage 4 which is axially positioned and of annular section transverse to the axis of the cyclone. This communicates at its upper end with a spiral casing 7A communicating with a tangential exit 7.

At the lower end, the separating chamber 104 is open to the interior of a chamber 14 which, in turn, is open at its lower end to an axially positioned discharge orifice 11.

Generally, the fluid to be separated enters the cyclone through tangential entry 1 into the spiral chamber 1A, and thence enters a cylindrical portion 2 of the separating chamber 104, this being immediately below the spiral chamber 1A. The fluid then follows a helical path with decreasing radius downwardly into a lower conical portion 3 of the separating chamber, the tangential velocity of the fluid increasing as it moves to a smaller radius during such passage. This conical restriction induces an upward motion in the upper portion of fluid within the separating chamber 104 driving it up and towards the annular fluid exit passage 4.

The passage 4, as shown in FIG. 1, extends upwardly from a lower end within cylindrical portion 2 and is coaxially arranged therewith and thence, as viewed in axial section, expands in cross-sectional size and turns outwardly away from the axis until the fluid therewithin forms a vortex swirl which moves outwardly through spiral chamber 7A to leave via exit 7. During passage through exit 7, both axial and tangential velocities are reduced and converted into pressure energy. A result of this is that a central core of the fluid within the separator, which core extends lengthwise at the separating chamber 104, is permitted to become a partial vacuum and filled with water vapor. Instruction of air at the bottom end of the cyclone, which might otherwise occur due to thisp partial vacuum, is prevented by blockage by a blunt cone 8 positioned within the chamber 14 and extending transversely across and immediately below the bottom end of the casing 102. This cone has a central depression 10 which assists in holding the core 13 in a central position.

Particles of suspended matter in the incoming fluid and which have a higher density will be subjected to centrifugal forces in the separating chamber and, if their normal rate of settling is sufficiently high, they will be flung outwards towards the walls of the casing 102 at the locations of the cylindrical portion 2 and conical portion 3. Next to the stationary inner surfaces of the casing 102 at the locations of the cylindrical portion 2 and conical portion 3 thereis a slow moving boundary layer which will receive the particles. The boundaryy layer is forced downwards towards the apex of the conical portion 3 due to the pressure gradient of the vortex which is formed in the chamber 104, as is discussed in greater detail later, and will thence empty outwards into chamber 14 via the lower outlet end of the chamber 104.

The chamber 14 is of shallow cylindrical configuration, with the blunt cone 8 being positioned to extend transversely therewithin, being supported, such as by rods 9 spaced about the internal periphery of the side wall of the chamber, and spaced from an upper transverse wall 14A of the chamber 14 and a lower transversely extending orifice plate 12 which wall 14A and plate 12 defines the upper and lower boundaries of the chamber 14. The fluid entering the chamber 14 may pass radially outwardly along the upper surface of the cone 8, thence downwardly between an annular gap between the periphery of the cone 8 and the side wall of the chamber 14 thence radially inwardly beneath the cone 8 and the lower orifice plate 12 to discharge through to the central orifice 11.

The result of the above fluid flow conditions is that a fluid mixture admitted into the cyclone via the entry 1 is separated such that a lower density component emerges from the exit 7 and a higher density component emerges from the orifice 11. If the inlet fluid comprises, for example, a mixture of water and particulate material of density greater than water, the tendency will be for the outlet stream from orifice 11 to comprise water in which the concentration of particles will be increased as compared with the outflow from exit 7. Again, should the inlet fluid comprise a mixture of liquids the tendency will be for the more dense component liquid to emerge from the orifice 11 and for the less dense component liquid to emerge from the exit 7.

Figure 3:
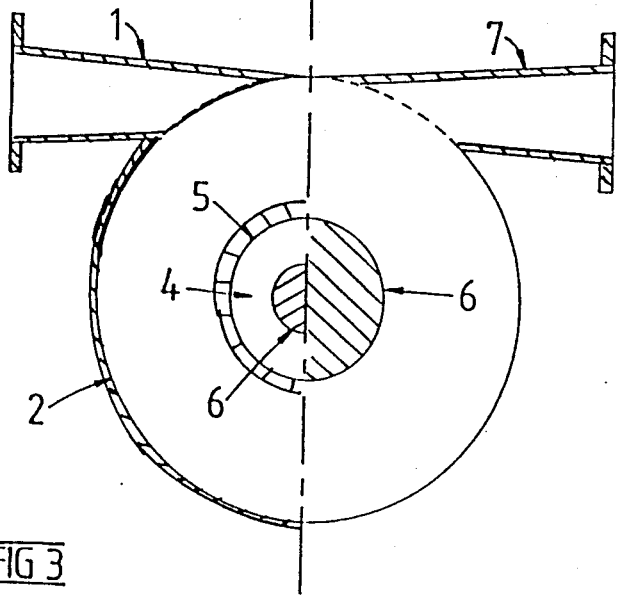
FIG. 3 is a view like FIG. 4, but showing a modification of the inlet to the cyclone.

FIG. 3 shows a modification of the construction of FIG. 1 and 2, wherein the spiral chamber 1A is not provided the duct which defines inlet 1 being of simple tangential form.

As shown in FIG. 2, the passage 4 is defined between conical surfaces 5 and 6 arranged coaxially within the separating chamber 104 and extending downwardly from a location above chamber 1A in the manner of a vortex finder, to a location within the cylindrical portion 2 and somewhat below the axial position of the tangential entry 1. At the lower ends, these surfaces 5 and 6 extend at a small outward and upward slope relative to the axis of the cyclone this slope gradually and smoothly increasing in the upward direction and the surfaces becoming normal to the axis of the cyclone, at the location where the outer of the two conical surfaces, surface 5, reaches the upper part of the entry 1. At this point, the radius of the surfaces 5 and 6 measured outwardly from the axis of the cyclone is about one half of the radius of the cylindrical portion 2. In this arrangement, the surface 6 is defined as the outer surface of element 110. The surface 5 may similarly be formed on a somewhat hollow cusp shaped and generally frustoconical element 112. This element may be thin walled, as shown, whereby to present an outer surface 5A, open to the conical portion 2 and spiral chamber 1A, which is substantially the same shape as the surface 5. However, in FIG. 4, a slightly modified arrangement is shown in which a frustoconical surface 31 which is straight sided when viewed in axial section is formed around and coaxial with surface 5A. This may be formed, for example, of a hollwo conical element 114 which is positioned over the element 112 so that an outer surface 31 of the vortex finder which forms the passage 4 is defined on this conical 31 element and is straight sided, the space between the elements 112, 114 being closed to access by fluid at the upper and lower ends thereof, where the elements 112, 114 are joined to each other.

Figure 4:
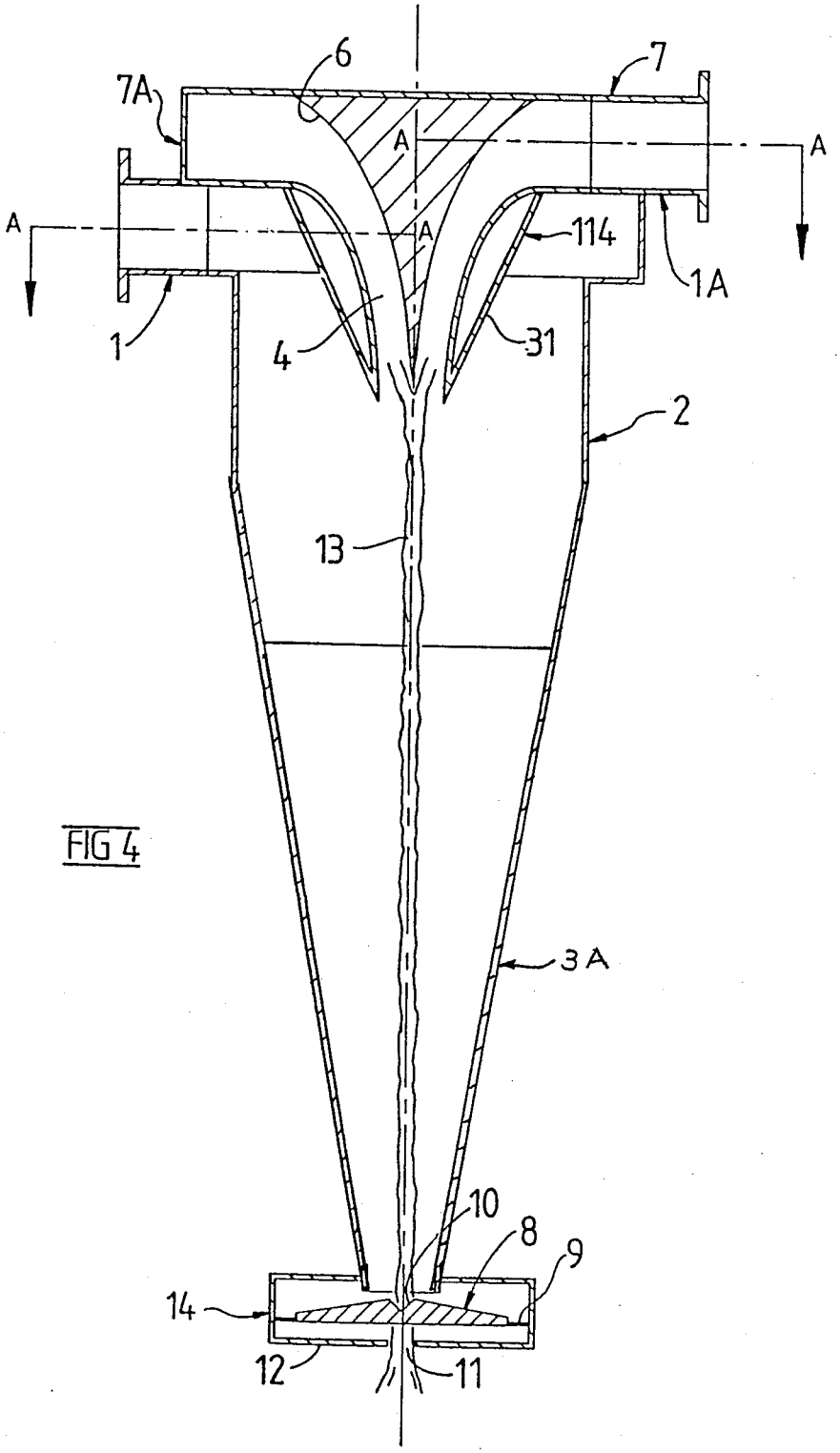
FIG. 4 is an axial cross-section of a modified form of fluid cyclone constructed in accordance with the invention.

Also, in the arrangement of FIG. 4, the conical portion 3 of FIG. 1, which conical portion has curved side walls when viewed axial section is replaced by a conical portion 3A which is straight sided when viewed in axial cross-section. The influence of the changes in the configuration of the outer surface of the vortex finder and of the surface of the conical portion are discussed later.

Figure 5:
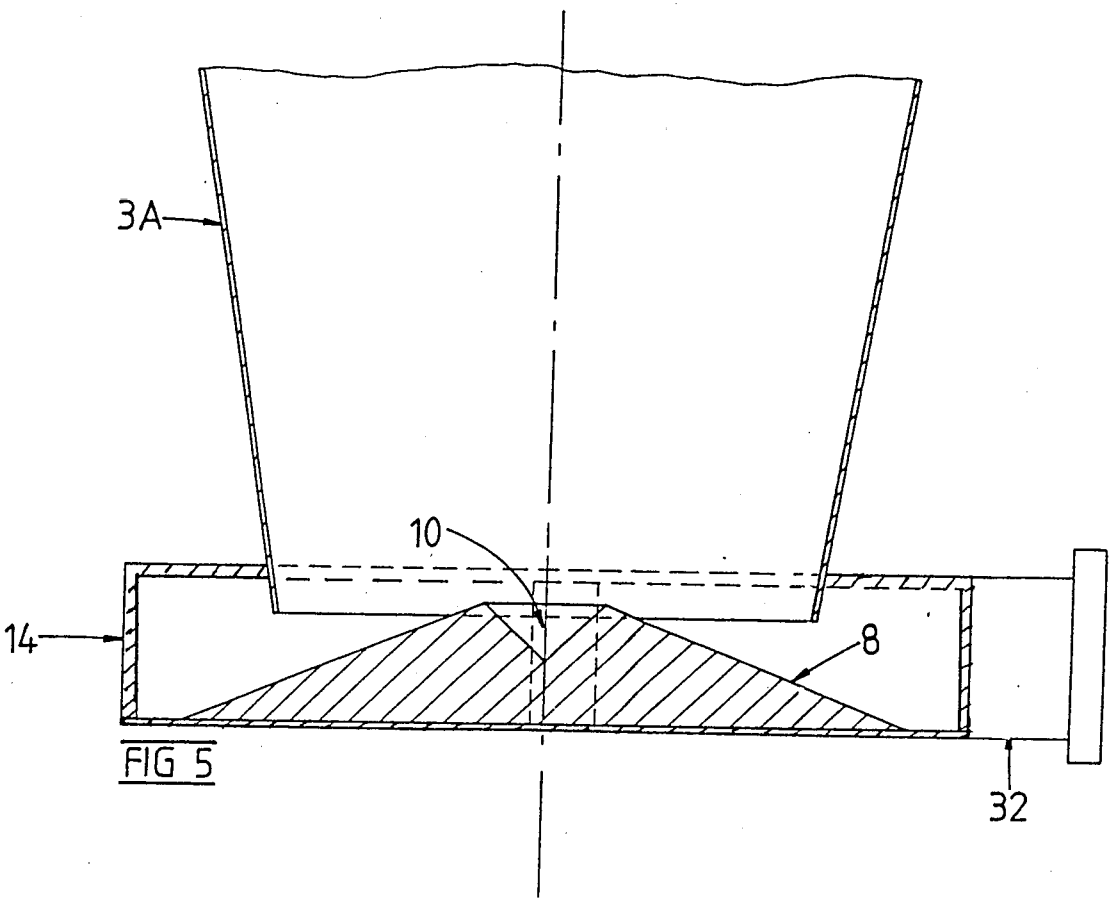
FIG. 5 is an enlarged view of a lower end of the cyclone of FIG. 1, but showing a modification thereof.

In FIG. 5, there is also shown a modification of the arrangement of the chamber 14 and cone 8. In this instance, the fraction of the separated fluid to be removed at the lower end of the separator (that being more dense or containing denser particles) exits from chamber 14 by means of a tangential exit 32 rather than being taken around cone baffle 8 to the underside of the cone 8 shown in FIG. 1. Thus, in FIG. 5, orifice plate 12 is not shown, cone 8 itself forming the lower surface of the chamber 14 and the exit 32 being formed in the side of the chamber 14. This form of design is preferred where its desirable to use the pressure in the fluid to feed other cyclone devices which will operate to produce further separation.

In order to more fully understand the manner of operation of cyclones constructed in accordance with this invention, certain theoretical aspects of the operation will now be described.

Firstly, velocities in a hydrocyclone are considered in cylindrical co-ordinates about the central axis. The components of tangential velocity $V_\theta$, axial velocity $V_z$ and radial velocity $V_r$ will be considered separately below.

1. Tangential Velocity $V_\theta$

If there were no friction, a condition of free vortex would exist where the porduct of tangential velocity and radius would be a constant; if there was an infinite friction then the fluid would rotate as a solid body and velocity would be proportional to radius. The actual velocity distribution in the vortex formed in a hydrocyclone is neither. Usually for the space between the radius of the fluid exit to the boundary layer at the wall the distribution is an intermediate of the two extremes above may be approximated by the equation.

$$V_\theta = k\, r^n \qquad \text{Equation 1}$$

where $V_\theta$=tangential velocity r=radius n=an exponent which must be somewhere between +1 and −1 k=a constant depending on entry energy

The value of n depends upon the energy losses from friction and turbulence in the vortex which depends in turn upon fluid properties and the design. In a typical case of a hydrocyclone of design shown in FIG. 1 it was determined as −0.64, a negative value of n in the range where the equation fits, means that the velocity is larger at smaller radii.

The tangential velocity reaches a maximum value at radius value somewhat less than the fluid exit radius and is then less at smaller radii.

The very centre of the vortex is often void of fluid, which would be filled with air in the case of most hydrocyclones, but which is often a partial vacuum in the case of the designs of this invention.

2. Radial Velocity

The average axial motion of the fluid was described earlier as downward near the wall and upward near the centre for FIG. 1. The inner layers of fluid are turned back earlier by the conical restriction and the outer layers progress further downwards and are turned back and inwards at the bottom cone 8.

In the upstream flow the axial velocity is a maximum in the middle where the tangential velocity is less such that the total content of kinetic energy is similar. The volume of the upstream flow often exceeds that leaving by the top exit such that the surplus then joins the inflow and moves downward. This assists the separation process.

3. Radial Velocity

The radial velocity of the main fluid in the cylinder section is very small whereas, in the conical portion, fluid is forced inward by the wall. There is more extensive radial movement in the lower chamber 14 as fluid moves out and in around the blunt cone and also in passage 4 where the fluid at the top moves outward towards the exit 7.

Next, conditions within the cyclone relating to the boundary layer on the inner surface of the cyclone casing defining the separating chamber 104 are considered.

The walls of a hydrocyclone are stationary and the fluid next to this wall is moving slowly due to the viscous drag of the fast moving fluid further in. This boundary layer consists of an outer viscous portion and an inner turbulent layer. The movement of fluid within this layer is very important to the performance of the invention.

1. Fluid Motion

Figure 6:
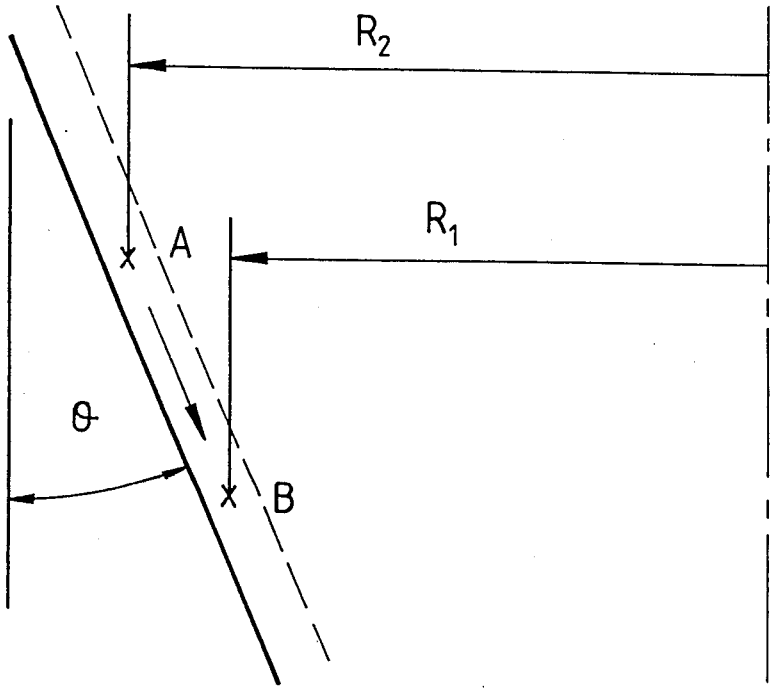
FIG. 6 is a diagram explaining parameters used in a mathematical formula useful in describing the invention.

Consider the boundary layer in the conical portion in the body of the hydrocyclone as represented in FIG. 6. The fluid outside the boundary layer is moving with a high tangential velocity such that there will be a considerable pressure differential between radius $R_2$ and $R_1$ due to the centrifugal force acting on the intermediate layer. This same pressure will be felt at points A and B, two points in the boundary layer at the same distance from the surface of the cone. However, the fluid between A and B is moving with little tangential velocity and there is insufficient centrifugal force to create a pressure differential to complete with that between $R_2$ and $R_1$ in the body of the fluid. As a result, fluid from A is driven towards B until the pressure differential associated with friction on the wall makes up the difference from centrifugal force. Thus, wherever a vortex is in contact with a stationary conical wall there will be a movement of fluid in the boundary layer towards the apex of the cone. Furthermore, where the angle between the conical wall and the cnetreline, shown as $\theta$ in FIG. 5, is larger, the downward velocity in the boundary will be faster and the layer thinner.

2. Curved Cones

On consideration of the use of a straight-sided conical portion in most hydrocyclones, in light of a distribution of tangential velocities in which the velocity rises at smaller radii, it is noted that the downward velocity at the wall along the cone will also rise and may reduce the thickness of the boundary layer.

In considering a hydrocyclone designed to remove solids, such as shown in FIG. 1, this reduction in thickness of the boundary layer will not influence small particles which remain in the layer but large particles will protude from the layer into the faster moving fluid and thus be propelled around at high speed. The resulting centrifugal force acts outward whereas the reaction of the wall has an upward as well as an inward component. a large particle may thus be held in a rotating orbit at some point in the cone where the downward drag force of the boundary layer fluid is equal to the upward component of the wall reaction. U.S. Pat No. 2,927,693, describes hydrocyclones for removing dirt and woody pieces from groundwood pulp in the paper industry and found that by curving the cone to reduce the supporting angle where the tangential velocity was highest the efficiency of removal of woody pieces was improved. an equation giving the contours of a curve found particulaarlyy suited to minimize orbiting of particles is given below.

$$h = K(R_1^{2n} - R_2^{2n}) \qquad \text{Equation 2}$$

where h=position down the cone $R_1$=the radius of the cone at a position h $R_2$=the radius of the cone at the top n=the tangential velocity exponent of Equation 1 k=a constant calculated from the overall length of the conical portion 3 using the equation.

Figure 7:
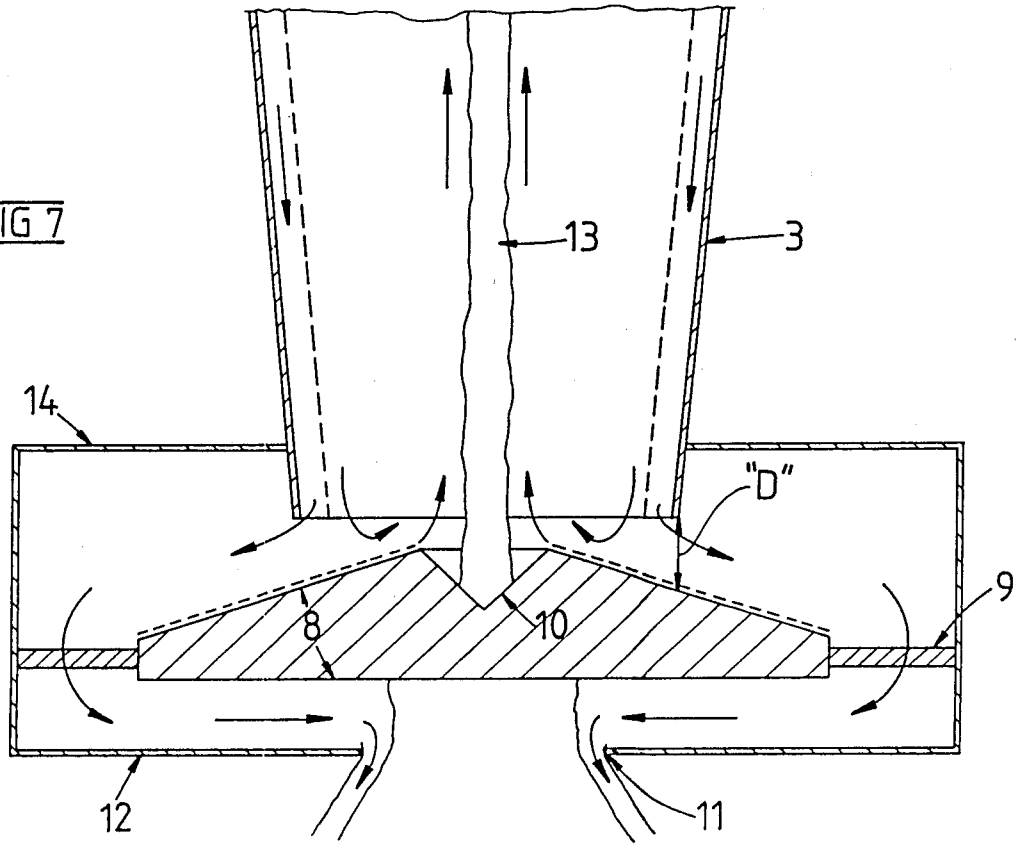
FIG. 7 is an enlarged view of a lower end of the cyclone of FIG. 1 with arrows indicating the axial and radial movement of the fluid.

This equation is based on a condition of constant downward velocity of the boundary layer and upward supporting component of the wall throughout the region where the tangential velocity of the vortex is defined by Equation 1. Experience has shown that this design of curve for the cone gives rise to greater efficiency in removal of woody pieces from pulp and also reduced abrasion due to orbiting of large grit particles.

the lower portion of the hydrocyclone of FIG. 1, particularly the portion thereof including the chamber 14 and the cone 8, form a core trap, as described, for the purpose of preventing ingress of air into the cyclone, and to assist in stabilizing the inner core 13.

the bottom portion of the hydrocyclone of FIG. 1 is shown in more detail in FIG. 7, in which broken lines representing a division between the boundary layer and the inner fluid and arrows show the axial and radial direction of fluid motion at the bottom of the vortex. The fluid motion in the boundary layer of all conical surfaces in contact with a vortex is towards the apex and a similar motion is induced in the adjacent inner fluid.

The boundary layer of conical portion 3 carries solids downwards and when the cone suddenly ends is flung outwards into chamber 14. It should be noted that if the surface were to curve outward and permit the presence of an outer surface which was conical expanding in radius as it moved downward then an upward flow would be induced in the boundary layer which would meet the downward movement of the layer on conical portion 3 at the point of minimum radius and induced an inflow of at least part of the layer with its solids. A sudden and sharp ending of conical portion 3 is thus desirable.

The blunt upper conical surface of cone 8 induces a layer moving inwards. This layer is very thin since it has just started to form and has not had a chance to build up because of the steep angle. While there may be some returning of very fine particles in this layer the amount is minimal since most of the solids is at the outer surface of chamber 14 to which there is only a connection by the small support rods 9.

The inward flow of this layer induces an inward flow of the innermost portion of the descending fluid and then an upward motion as the fluid reaches the inner rim of cone 8, where it breaks into the conical depression 10 and streams upward.

As mentioned, at the very centre of the vortex there is a core 13 devoid of fluid. If cone 8 continued to a point with no central depression this central core would be pushed aside by the stream of boundary layer fluid leaving the apex of the blunt core and wobble around. The depression 10 causes the boundary layer to leave in a stream around the core and thus stabilizes its position. However, if due to operating pressures, the liquid free core ends before the core trap the depression 10 may be omitted.

The outlet defined by passage 4 is in the nature of an energy recovery outlet.

Figure 8:
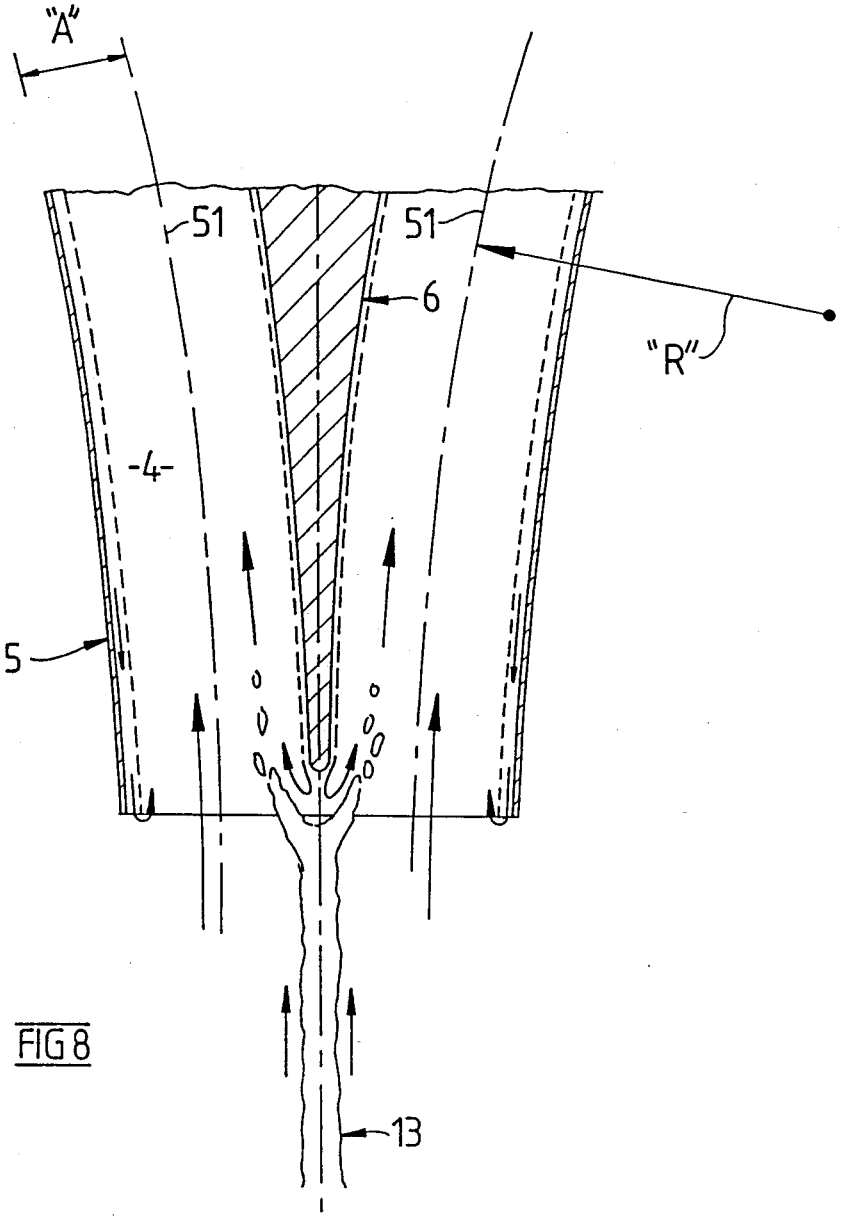
FIG. 8 is an enlarged fragmentary cross-section of an upper outlet of the cyclone of FIG. 1 with arrows indicating the axial and radial movement of portions of the fluid.

FIG. 8 shows the coaxial passage 4 of FIG. 1 with the transition point of boundary layers marked with dotted lines and axial and radial directions of motion by arrows. The vortex of the hydrocyclone continues to swirl in the coaxial passage and induces flow in the boundary layers of the conical walls towards their apex. The outer surface 5 has steeper slopes and more perimeter so that the small backflow against the mainstream is greater than at the inner surface 6. However, there is a stream of fluid from boundary layer fluid which leaves the tip of the inner cone and causes the core of water vapor to be deflected around it where it circles and disintegrates into bubbles in the stream sucked into the space, 4 which then collapse as the pressure increases in the channel. This effect is represented in FIG. 8.

The conical element 114 defining surface 31 was mentioned proviously in relation to FIG. 4.

The behaviour of fluid in the boundary layer, on a cone in a vortex, proves beneficial in use of the element 114 in FIG. 4. There is a by-pass of fluid inall cyclones as a boundary layer flow from the inlet across the top along the outside of the vortex finder and out the exit. This by-pass of fluid is unavoidable and the best that a designer can do is to attempt to prevent the dense particles from being swept out with it. The vortex finder outlet pipe in the conventional cyclone is employed for this very purpose. The element 31 is superior, as the boundary layer on its surface will be very thin and any particle which might be carried in it will have a high tangential velocity from fluid sweeping around the surface which will cause it to move into the main stream.

The core trap design of FIG. 7 and energy recovery design of FIG. 8 are both required and work together to produce the desirable results of this invention.

Where the design of FIG. 1 or 4 is used to permit a hydrocyclone to operate at very low pressure yet efficiently remove solids, the fluid and any gases are sucked out of the core to produce a vacuum while entry of air is prevented at the bottom while the particles may leave. With a vacuum at the core there is a possible pressure differential of an additional 14 p.s.i. between the inlet and the core compared to the conventional hydrocyclone with atmospheric pressure at the core. This is particularly advantageous where the user has limited inlet pressure available. A given design of the energy recovery type operating at 14 p.s.i. will be equivalent to a conventional unit of similar design operating at 28 p.s.i. whereas the energy recovery unit at 6 p.s.i. will be equivalent to a conventional one at 20 p.s.i.

U.S. Pat. No. 3,216,165 describes an exit arrangement like that of FIG. 5.

In applications of that previous invention, the flow of reject fluid was frequently throttled using a vortex nozzle a tangential inlet into a space between two disks with a hole in one of them. The major throttling in this nozzle was from the pressure drop across the vortex formed in the space between the disk as is the case between the bottom of cone 8 and plate 12 in FIGS. 1 and 4. It should be noted, however that the arrangement described in this invention differs in one important aspect in that the tangential velocity of fluid entering the vortex nozzle is from the residual tangential velocity in the reject fluid leaving from the bottom of conical portion 3 or 3A instead of the velocity resultant from a flow through the area of a tangential entry pipe. As a result when the quantity of solids in the reject stream is higher the tangential velocity of fluid leaving the bottom of cone 3 and as a result the throttling effect of the vortex will be less. This interaction is desirable as it ensures an adquate flow of reject stream in the event of a higher content of material in the inlet stream to the cyclone.

Many of the proportions of the design of the invention may be changed for differing applications. However, there are certain relationships which should be kept in proper range for best performance.

1. Energy Recovery Channel

The diverging angle in the energy recovery channel should be kept to less than 5 degrees to give proper energy recovery. If it is not, excessive backflow along the surfaces will occur.

The diverging angle is marked "A" in FIG. 8 and is the angle between the surface 5 or surface 6 measured relative to the line 51 representing the mean flow path of the fluid in passage 4, all as viewed in axial section.

The radius of curvature of the mean flow path in passage 4 should be at least as large as the width of the channel, if not larger, in order to give the fluid as flat a velocity profile as possible to give efficient energy recovery. This radius of curvature is the radius as viewed in axial section and marked "R" in FIG. 8.

2. The Reject Outlet

For normal use, the spacing "D" (FIG. 7) in the core trap defined between the lower end of conical portion 3 and the blunt cone 8 should be less than the depth of fluid in the vortex at the end of conical portion 3 (ie ½ (diameter - core size)). This minimizes the chance of reintraining solids from chamber 14 in the upward flow near the core.

In instances where it is desirable to remove only the coursest material and retain fine material, chamber 14 may be internally lengthened and cone 8 moved away from the end of conical portion 3. Water injected into chamber 14 can then carry the fine solids across the boundary layer of cone 8 where it can be swept up next to core 13 into the hydrocyclone. This is practiced in the invention of U.S. Pat No. 2,927,693.

The arrangement of FIG. 5 produces an outlet pressure which is a linear function of the operating pressures.

$$H_r = aH_{in} + bH_{out} = c$$

where $H_r$=reject pressure (ie pressure at exit oridice 11)

$H_{in}$=inlet pressure (ie pressure at inlet 1)

$H_{out}$=accepted outlet pressure (ie pressure at exit 7)

a, b and c=constants.

The constant "c" is approximately equal to the difference in hydrostatic head between the accepted and reject outlet. If the diameter of the bottom of conical portion 3 is equal to that of the outlet from chamber 104 into passage 4 then "a" is almost zero. As the bottom of conical portion 3 is made larger "a" is increased. Usually the sum a + b is approximately 1.

3. Outlet Diameter

Most commercial hydrocyclones are designed with the diameter of the exit 4 about ⅓ that of the cylinder 2. Although the invention can operate with these proportions, it gives much better performance if the exit 4 idameter is made smaller such as 1/5 the diameter of cylindrical portion 2. The energy recovery permits greater tangential velocity to be used near the exit 4 producing very high centrifugal forces in that region. The resultant high level of kinetic energy in the exiting fluid is not lost as it would be in conventional cyclones but is recovered.

4. Area of the Tangential Inlet

In the conventional cyclone, the area of the tangential inlet, at the point of entry to the interior, is generally made smaller than the exit to produce a high tangential velocity. This is not the best choice for the energy recovery cyclone of this invention as it leads to high losses from friction against the outer walls. It is preferable to use an inlet area equal or even larger than the outlet area but with a small outlet for given diameter to develop the high velocity at smaller radius away from the stationary wall.

It should be noted that the design principles of lower velocity near the wall and higher velocity near the exit is particularly applicable when the fluid has a high kinematic viscostiy as in the case of oil.

The behavious of fluid in the boundary layer of the contact between a vortex and a conical surface plays an important part in determining the flow pattern in this invention. As the size of the hydrocyclone is reduced, the thickness of the boundary layer does not shrink as fast as the diameter. Hence the proportion of the fluid contents which is boundary layer is larger for smaller sizes of units. The pressure gradient in the radial direction in smaller units is also higher resulting in a higher velocity towards the apex of the boundary layer on conical surfaces. These factors make it necessary to modify the design as the size of unit is reduced.

It is desirable to reduce the slope of the outer conical wall 3 or 3A, in order to reduce the boundary layer velocity. With the straight sided conical portion 3A this requires changing the proportions of the cone to make it longer for a given diameter at the top end. With the curved conical portion 3, the slope can be reduced further over most of its length, and particularly at the critical bottom portion, by increasing the curvature by use of a larger value of "n" in equation 2.

Figure 9:
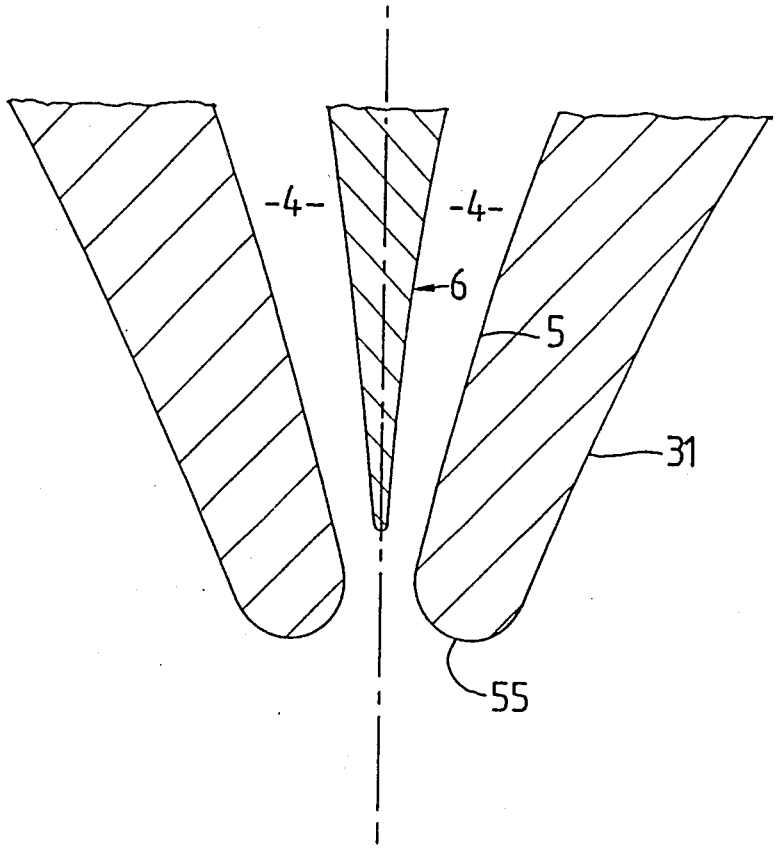
FIG 9 is a view like FIG. 8, but illustrating a modification to the form of the upper outlet of FIG. 4.

The short circuiting boundary layer near the surface leading to the vortex finder is also influenced by a reduction in size. The layers on the surface of cone 114 and curved conical surface 5 come together in small units and continue as a converging conical jet of fluid which interfers with the central stream of fluid proceeding to the exit channel 4. FIG. 9 shows a modification to this portion of the design by which the boundary fluid on the surface of element 114 is turned inwards around a curved surface 55 until it meets and opposed the motion of the fluid on the conical surface 5.

I claim:

1. A fluid cyclone having an upper cylindrical end portion with an inlet thereto and outlet therefrom, each of which is tangential to said cylindrical portion, said cylindrical portion merging into a lower conical portion with tapers inwardly towards a cone plate means positioned directly beneath but spaced from a reject outlet in the lower end of said lower portion, the improvement comprising vortex finder means defining an uninterrupted annular outlet passage, having an axially extending portion and a radially extending portion, said passage gradually increasing in cross sectional flow area, from an axial inlet of said vortex finder means, which inlet is located in the cylindrical portion of the cyclone, said passage extending upwardly from said axial inlet toward said tangential outlet without any constriction from said axial inlet to said tangential outlet and said radially extending portion of said passage merging smoothly into said tangential outlet, said vortex finder means defining said outlet passage comprising an inner core cone and an outer core cone spaced apart from one another, said space defining said annular outlet passage the inlet to said annular passage being disposed co-axially with said cylindrical portion of the cyclone, and originating at the end of said inner cone closest to said lower conical portion of said cyclone and the length of the axially extending portion of the outlet passage being sufficiently long relative to the radially extending portion thereof so as to produce a gradual transition of velocity energy into pressure energy and thereby avoiding vortex instability in said outlet passage.

2. A fluid cyclone as claimed in claim 1, wherein said tangential inlet is in the form of a duct.

3. A fluid cyclone as claimed in claim 1 wherein said tangential inlet is in the form of a spiral chamber communicating with said cylindrical portion.

4. A fluid cyclone as claimed in claim 1, wherein said lower conical portion of said cyclone has straight sides 5. A fluid cyclone as claimed in claimed 1, wherein said lower conical portion has curved sides.

6. A fluid cyclone as claimed in claim 1, wherein the cone plate means is positioned within a lower chamber so as to receive fluid from the reject outlet which impinges on the upper surface of the cone plate means and is directed within said lower chamber outwardly relative to the axis of the cyclone.

7. A fluid cyclone as claimed in claim 1, wherein said upper surface of said cone plate means defines a lower internal surface of said lower chamber and said lower chamber is provided with a tangential outlet.

8. A fluid cyclone as claimed in claim 6, wherein said cone plate is positioned between upper and lower internal surfaces of the lower chamber and the periphery of the cone plate means is inwardly spaced relative to the internal side surface of said lower chamber, the lower chamber being provided with an axial orifice at the lower end thereof whereby fluid entering the lower chamber passes radially outwardly over the upper surface of said cone plate means, thence between the periphery of the cone plate means and the internal side surface of the lower chamber and thence radially inwardly below the lower surface of the cone plate means to exit the separator via said orifice.

9. A fluid cyclone as claimed in claim 1, wherein the diameter of said cylindrical portion is at least four times that of the vortex finder means.

10. A fluid cyclone as claimed in claim 1, wherein the total area for inlet of fluid into the cyclone separator is equal to or greater than the area of entry to the vortex finder means.

11. A fluid cyclone as claimed in claim 1, wherein the radius of curvature of the passage, measured to the mean path of fluid therein when viewed in an axial section of the separator between said mean path and the axis of the cyclone is at least equal to the width of the passage, measured normally to the mean path of fluid flow within the passage when viewed in axial section of the separator and measured from that mean path to the bounding surfaces of the passage to either side thereof.

12. A fluid cyclone as claimed in claim 1, wherein the diverging angle of surfaces defining said passage when viewed in axial section, and measured relative to the mean path of the path of fluid flow therewithin does not exceed 5°.

13. A fluid cyclone as claimed in claim 1 wherein said outer core cone terminates, below the inner core cone, with a rounded annular lip.

* * * * *